United States Patent [19]

Lohmann et al.

[11] 4,186,011

[45] Jan. 29, 1980

[54] COLOR PHOTOGRAPHIC RECORDING MATERIAL

[75] Inventors: Joachim W. Lohmann, Kuerten; Erwin Ranz; Martin Kupper, both of Leverkusen, all of Fed. Rep. of Germany

[73] Assignee: Agfa-Gevaert Aktiengesellschaft, Fed. Rep. of Germany

[21] Appl. No.: 847,851

[22] Filed: Nov. 2, 1977

[30] Foreign Application Priority Data

Nov. 5, 1976 [DE] Fed. Rep. of Germany ..... 2650715

[51] Int. Cl.[2] ..... G03C 1/76

[52] U.S. Cl. ..... 430/505; 430/506; 430/957

[58] Field of Search ..... 96/74, 95

[56] References Cited

U.S. PATENT DOCUMENTS

| | | | |
|---|---|---|---|
| 3,726,681 | 10/1973 | Pankow et al. | 96/74 |
| 3,849,138 | 11/1974 | Wyckoff | 96/74 |
| 4,040,829 | 8/1977 | Ohmatsu et al. | 96/74 |

*Primary Examiner*—Travis Brown
*Attorney, Agent, or Firm*—Connolly & Hutz

[57] ABSTRACT

In a color photographic material in which at least one of the partial images yellow, magenta and cyan is produced in a double layer consisting of a first layer of lower sensitivity and a second layer of higher sensitivity and arranged further away from the layer support than said first layer, at least one color unit, preferably the blue-sensitive and/or the green sensitive color unit consists of at least three layers.

(a) a first silver halide emulsion layer of low sensitivity containing a color coupler (b) a second silver halide emulsion layer which may contain a color coupler, and (c) a third layer which is free from silver halide, but contains a color coupler, the coupler in said layers a, b and c forming on color development dyes of substantially the same color which is complementary to that of the light to which the layers are sensitive.

4 Claims, No Drawings

COLOR PHOTOGRAPHIC RECORDING MATERIAL

This invention relates to a colour photographic recording material having several sliver halide emulsion layers such that each of the three spectral regions, blue, green and red, has, associated with it, at least one silver halide emulsion layer which is sensitive to light of this spectral region and contains a non-diffusible colour coupler for producing a dye which has a high absorption for this light, at least one of the three above mentioned spectral regions having, associated with it, at least two such layers differing from each other in their sensitivity, (speed), the more sensitive of these two layers being further removed from the layer substrate. The material according to the invention has improved sensitivity due to the presence of an additional layer of binder which is free from silver halide and contains colour coupler, arranged directly adjacent to the more sensitive silver halide emulsion layer.

For the production of colour photographic images, it is known to use recording materials which carry a red-sensitive, a green-sensitive and a blue-sensitive silver halide emulsion layer on a layer substrate, each of these silver halide emulsion layers containing non-diffusible colour couplers for producing the cyan, magenta and yellow partial colour images respectively, the colour of the partial colour image produced being in each case complementary to the spectral sensitivity of the silver halide emulsion layer. The usual colour photographic materials also contain other layers, for example a yellow filter layer between the blue-sensitive silver halide emulsion layer above it and the green-sensitive silver halide emulsion layer below it, and an anti-halation layer between the substrate and the lowermost silver halide emulsion layer. Additional intermediate gelatine layers and a covering layer may also be provided.

For producing colour photographic images, it is also known to use recording materials which have at least two silver halide emulsion layers for each of one or more of the three different partial colour images. According to British Patent Specification No. 818,687, the lowermost light sensitive colour producing layer unit of a colour photographic multi-layered material consists of two partial layers which contain silver halide and colour coupler and are sensitised to light of the same spectral region, the upper of the two partial layers having the greater sensitivity. In German Patent Specification 1,121,470, there is disclosed the use of such double layers differing in sensitivity, the more sensitive of the two layers producing the lower colour density in the process of colour development. This provides the possibility of increasing the sensitivity without at the same time adversely affecting the graininess.

Colour photographic recording materials having double layers for the various spectral regions have also been disclosed in U.S. Pat. Nos. 3,663,228 and 3,849,138. Here again, the upper of the two partial layers which are sensitive to light of the same spectral region has the higher sensitivity. The arrangements of layers described in these U.S. Patent Specifications, however, serve mainly to increase the exposure latitude, and there is no mention of any increase in sensitivity. FIG. 1*c* of these two U.S. Patent Specifications shows a material containing two laminates separated from each other by a neutral gray filter, each laminate consisting of a red-sensitive, a green-sensitive and a blue-sensitive silver halide emulsion layer.

In this case, therefore, the two partial layers of differing sensitivity which are sensitive to the same spectral region are not arranged adjacent to each other but accommodated in different laminates which differ from each other in their general sensitivity, each laminate containing several silver halide emulsion layers which differ from each other in their spectral sensitivity but all have a comparable general sensitivity. Partial layers having the same spectral sensitivity are, in each case, separated from each other by several layers of different spectral sensitivities and by the gray filter. Another arrangement which also provides for an increased margin of exposure latitude and which is similar to the one described above but contains coloured filters has been disclosed in U.S. Defensive Publication No T 860,004.

German Offenlegungsschriften Nos. 2,453,654 and 2,453,664 disclose arrangements of layers in which red-sensitive and/or green-sensitive partial layers are arranged above the blue-sensitive halide emulsion layer for the purpose of improving the sharpness. These arrangements, however, are not advantageous from the point of view of colour reproduction and are therefore only suitable for use with certain sources of light e.g. tungsten light.

Lastly, an arrangement of layers for improving sensitivity has been disclosed in German Offenlegungsschrift No. 2,530,645, according to which 1. the more sensitive of the two green-sensitive silver halide emulsion layers and the more sensitive of the two red-sensitive silver halide emulsion layers are arranged adjacent to each other in a comparatively more sensitive emulsion layer unit;
2. the less sensitive of the two green-sensitive silver halide emulsion layers and the less sensitive of the two red-sensitive silver halide emulsion layers are arranged adjacent to each other in a comparatively less sensitive emulsion layer unit;
3. the less sensitive emulsion layer unit is closer to the layer substrate than the more sensitive emulsion layer unit;
4. in each of the two emulsion layer units, the red-sensitive emulsion layer is closer to the layer substrate than the green-sensitive emulsion layer and
5. the less sensitive green-sensitive silver halide emulsion layer is adjacent to the more sensitive red-sensitive silver halide emulsion layer and closer to the layer substrate than the more sensitive of the two red-sensitive silver halide emulsion layers.

This material thus also has two or more laminates differing in their general sensitivity, with red-sensitive silver halide emulsion layers alternating with green-sensitive silver halide emulsion layers.

The use of layers which are free from silver halide and contain colour couplers in colour photographic materials is known per se. According to U.S. Pat. No. 2,546,400 and German Offenlegungsschrift No. 2,524,835, such layers containing diffusible or "semi-diffusion resistant" couplers are arranged adjacent to a silver halide emulsion layer for the purpose of improving the clarity, colour density and contrast or image sharpness. According to German Auslegeschrift No. 1,002,626, colour separation is improved by incorporating a non-diffusible colour coupler in a layer of binder which is free from silver halide, which layer of binder is situated between two differently sensitised silver halide emulsion layers which contain colour couplers.

It is an object of the present invention to provide a colour photographic recording material having several silver halide emulsion layers differing in their spectral sensitivities, which photographic material is superior to known colour photographic materials in its sharpness and, above all, in its sensitivity.

The invention relates to a colour photographic recording material containing several differently sensitised silver halide emulsion layers on a layer substrate, each of the three spectral regions, blue, green and red, having associated with it at least one silver halide emulsion layer which is sensitive to light of this spectral region and contains a non-diffusible colour coupler for producing a dye having a high absorption for this light, and at least one of the three above-mentioned spectral regions having associated with it at least two such layers of differing sensitivities, the more sensitive of these two layers being arranged further away from the support layer than the less sensitive layer, characterised in that at least one of the three aforesaid spectral regions has associated with it a colour unit consisting of:

(a) a less sensitive silver halide emulsion layer, which may be subdivided into two or more partial layers, containing a non-diffusible colour coupler for producing a dye which has a high absorption for light of this spectral region;

(b) a more sensitive silver halide emulsion layer which may contain a non-diffusible colour coupler for producing a dye which has a high absorption for light of this spectral region, and (c) a light insensitive layer of binder arranged immediately above layer (b), which layer of binder contains a colour coupler for producing a dye which has a high absorption for light of this spectral region.

The material according to the invention comprises the usual three colour units for producing the yellow, magenta and cyan partial image, respectively. Each of these colour units may consist of two or more partial silver halide emulsion layers differing in sensitivity and, according to the invention, at least one of the colour units has at least two silver halide emulsion layers of differing sensitivities and, in addition, a light insensitive layer of binder which is free from silver halide and contains colour coupler arranged immediately above that silver halide emulsion layer which has the highest sensitivity. Each of the colour units is associated with one of the three spectral regions blue, green or red. This means that the silver halide emulsion layers of the colour units have a spectral sensitivity for light of the corresponding spectral region and contain a non-diffusible colour coupler for producing a dye which has a high absorption for light of this spectral region. The colours of the dyes produced in this way are therefore complementary to the colours of the light used for exposure.

According to one embodiment of the present invention, the partial layers of one colour unit are combined to form layer units having the same spectral sensitivity, i.e. partial layers of the same colour unit are always arranged adjacent to each other. The red-sensitive layers are normally situated lowermost in the colour photographic material, i.e. closest to the layer substrate. The partial layers for the green-sensitive layer unit are arranged above the red-sensitive layers, and the blue-sensitive layer unit is arranged uppermost. Between the blue-sensitive and the green-sensitive layer unit there is normally a yellow filter layer containing yellow colloidal silver or a yellow organic dye to prevent substantial quantities of blue light entering the green-sensitive or red-sensitive layers underneath. Preferably, at least the blue-sensitive and/or the green-sensitive layer unit has the features of the invention, i.e. an additional layer of binder which is free from silver halide and contains colour coupler.

According to another embodiment of the present invention, the partial layers of a colour unit are not combined to form a layer unit. Instead, additional layers are arranged between the one or more less sensitive partial layer or layers and the most sensitive partial layer of a colour unit. These additional layers may be, for example, one or more partial layers of a different colour unit, for example as described in German Offenlegungsschrift No. 1,958,709. This makes possible numerous variations in the arrangement of layers.

Thus, for example, the more sensitive partial layers of two or three colour units may be combined to form a comparatively more sensitive emulsion layer unit while the less sensitive partial layers may in turn be combined to form a comparatively less sensitive emulsion layer unit. This inevitably means that, in the case of at least one colour unit, the more sensitive and the less sensitive of the silver halide emulsion layers of the same spectral sensitivity must be spatially separated from each other. Reference may be had in this connection to German Offenlegungsschriften Nos. 2,530,645 and 2,662,923.

The more sensitive silver halide emulsion layer and the one or more less sensitive silver halide emulsion layer or layers of the colour unit which according to the invention has the additional layer of binder which contains colour coupler and is free from silver halide may accordingly also be arranged adjacent to each other or spatially separated from each other. In all cases, however, the silver halide-free layer which contains colour coupler is arranged directly adjacent to and above the most sensitive silver halide emulsion layer of the same colour unit. Silver halide emulsion layers belonging to different colour units are generally not arranged adjacent to each other and are separated from each other by layers of binder in order to suppress, as far as possible, undesired accidental coupling with the colour developer oxidation product diffusing from an adjacent layer.

The most sensitive of the silver halide emulsion layers generally contains silver halide and colour coupler in such quantities that it has a higher proportion of silver halide/colour coupler than the less sensitive silver halide emulsion layer or layers. In special cases, if a layer which is free from silver halide and contains colour coupler is arranged according to the invention above the most sensitive silver halide emulsion layer, it is even possible to dispense completely with the use of a colour coupler in the most sensitive silver halide emulsion layer. In such an arrangement, the colour unit according to the invention therefore contains at least one less sensitive silver halide emulsion layer with colour coupler, one more sensitive silver halide emulsion layer without colour coupler and one insensitive layer of binder with colour coupler.

The additional layer of binder which is free from silver halide contains a colour coupler or a mixture of colour couplers in a quantity corresponding to approximately from 10 to 80% of the molar quantity of colour coupler in the one or more less sensitive silver halide emulsion layer or layers of the same colour unit. The colour couplers may be hydrophilic (water soluble or alkali soluble) or hydrophobic (insoluble in alkali). The fact that they are incorporated in a layer of binder which is free from silver halide is found to be advantageous since it permits extremely high packing densities to be obtained so that the additional layers may be kept very thin, for example from 0.5 to 2 μm. Dispersions of colour couplers normally used for incorporation in silver halide emulsions may be cast directly as additional layers. According to another possible embodiment, the additional layer consists mainly of polymeric colour couplers, and, if these have layer-forming properties, it is possible to dispense almost completely with an additional binder such as gelatine.

The layer of binder according to the invention, which contains colour coupler and is free from silver halide, produces an increase in sensitivity. This is accompanied with an increase in gradation, depending on the quantity of coupler in the adjacent, more sensitive silver halide emulsion layer b of the same colour unit. Increased gradation can be compensated for by applying a smaller quantity of layer b; this, in turn, has an advantageous effect on the sharpness and sensitivity of the lower-lying layers.

The additional layer according to the invention may also be used to compensate for the sensitivity loss which may be associated with other measures which are advantageous for the quality of the image. For example, the incorporation of DIR couplers in the yellow filter layer causes an increase in the inter-image effect and a reduction of fog in the adjacent magenta layer, but is associated with a loss in sensitivity. By employing the layer according to the invention, this sensitivity loss is in part compensated for (see Example 2).

Apart from the layers mentioned above, the colour photographic recording material according to the invention may contain other light-insensitive auxiliary layers, e.g. adhesive layers, anti-halation layers or covering layers, and in particular intermediate layers between the light sensitive layers to prevent diffusion of developer oxidation products from one layer to another. For the same reason these intermediate layers may also contain certain compounds which are capable of reacting with the oxidation products of the developer. These layers are preferably arranged between adjacent light-sensitive layers having differing spectral sensitivities.

If the less sensitive silver halide emulsion layer of a colour unit is subdivided into two or more partial layers, these are generally arranged so that the more sensitive partial layer is further removed from the support layer than the one or more less sensitive partial layer or layers of the same colour unit. Each of these partial layers contains a colour coupler and each of the more sensitive silver halide emulsion layers preferably contains a higher proportion of silver halide to colour coupler than the next less sensitive silver halide emulsion layer of the same colour unit.

The essential factor in the differing sensitivities of the individual partial layers of a colour unit is not the absolute sensitivity but the effective sensitivity, taking into account the position of the partial layer within the colour photographic multi-layered material. Within any one colour unit, the difference in effective sensitivity between one light sensitive halide emulsion layer and the next more sensitive silver halide emulsion layer is suitably between 0.2 and 1.0 relative log I.t units.

For any individual case, the sensitivity difference is chosen so that colour photographic processing results in a balanced gradation curve without perceptible distortion. The components of the more sensitive layer or layers are suitably calculated so that colour development of the more sensitive layer or layers results in a lower colour density than colour development of the less sensitive layer or layers. This can be achieved by applying a smaller quantity of silver and/or using a different coupler/silver ratio.

Each of the aforesaid light sensitive silver halide emulsion layers has, associated with it, a colour coupler which is capable of reacting with the colour developer oxidation products to form a non-diffusible dye. The colour couplers are preferably non-diffusible and accommodated in the light sensitive layers. As already mentioned above, however, the most sensitive silver halide emulsion layer of a colour unit which according to the invention contains an additional layer of binder which is free from silver halide and contains colour coupler need not necessarily contain a colour coupler itself since the adjacent layer of binder contains such a colour coupler.

The colour couplers contained in the various partial layers having the same spectral sensitivity and, optionally, also in the additional layer of binder which is free from silver halide need not necessarily be identical but they should give rise to the same colour in the process of colour development, normally a colour which is complementary to the colour of the light to which the light sensitive silver halide emulsion layers are sensitive. The red-sensitive silver halide emulsion layers therefore have associated with them at least one non-diffusible colour coupler for producing the cyan partial colour image, generally a coupler based on phenol or α-naphthol. The green-sensitive silver halide emulsion layers have associated with them at least one non-diffusible colour coupler for producing the magenta partial colour image, usually a colour coupler based on 5-pyrazolone or indazolone. The blue-sensitive silver halide emulsion layers have associated with them at least one non-diffusible colour coupler for producing the yellow partial colour image, generally a colour coupler having an open chain ketomethylene group. Large numbers of colour couplers of these types are known and have been described in numerous patent Specifications. References may be found, for example, in the publication entitled "Farbkuppler" by W. Pelz in "Mitteilungen aus den Forschungslaboratorien der Agfa, Leverkusen/-Munchen", Volume III, page 111 (1961) and the publication by K. Venkataraman in "The Chemistry of Synthetic Dyes", Volume, 4, 341–387, Academic Press (1971).

The colour couplers used may be either the usual 4-equivalent couplers or 2-equivalent couplers which, as is known, are derived from 4-equivalent couplers by containing, in the coupling position, a substituent which is split off in the coupling reaction. 2-equivalent couplers suitable for the present invention include both those which are practically colourless and those which have an intense colour of their own which disappears in the colour coupling reaction or is replaced by the colour of the image dye produced by the reaction. According to the invention, the last mentioned couplers may be present in addition in the light sensitive silver halide emulsion layers, where they serve as masking couplers for compensating for unwanted side densities of the image dyes. Suitable 2-equivalent couplers also include the known white couplers which do not produce a dye when they react with the oxidation products of colour developers. The 2-equivalent couplers also include the known DIR-couplers. These are couplers in which a group which can be split off is situated in the coupling position, this group being released as diffusible development inhibitor when the reaction with oxidation products of colour developer takes place.

If desired, colour coupler mixtures may be used to obtain a desired colour shade or a desired reactivity. For example, water-soluble couplers may be used in combination with hydrophobic, water-insoluble couplers.

Whereas water-soluble couplers are generally added to the emulsion in the form of aqueous alkaline solutions, hydrophobic couplers may be incorporated by one of the known emulsification processes in which, for example, the coupler may be dissolved in an organic solvent, optionally in the presence of a high-boiling coupler solvent, and then dispersed in a gelatine solution. Dibutyl phthalate and tricresyl phosphate are examples of high-boiling coupler solvents. Other coupler solvents have been described, for example, in U.S. Pat. Nos. 2,322,027; 3,689,271; 3,764,336 and 3,765,897.

Hydrophobic couplers may also be incorporated by preparing aqueous dispersions of these couplers and adding them to the appropriate casting solutions. In such cases, aqueous slurries of the couplers are finely milled, for example by vigorous stirring with the addition of sharp sand and/or by means of ultra-sound. Reference may be made in this connection to German Offenlegungsschrift No. 2,609,741.

At least one colour unit in one or more of the comparatively less sensitive silver halide emulsion layers should contain a non-diffusible compound which is capable of reacting with colour developer oxidation products to release a diffusible development inhibitor. The corresponding comparatively more sensitive silver halide emulsion layer may also contain an additional nondiffusible compound of this kind capable of reacting with developer oxidation products to release a diffusible development inhibitor. Such compounds which release development inhibitors are already known, for example the known DIR-couplers, which are 2-equivalent colour couplers in which colour coupling releases a diffusable development inhibitor and at the same time a dye is formed from the coupler molecule. DIR-couplers of this kind have been described, for example, in U.S. Pat. No. 3,227,554.

It is particularly preferred, however, to use development inhibitor releasing compounds of the kind which react with colour developer oxidation products to release a development inhibitor without at the same time forming a dye. Such compounds, which may be referred to as DIR compounds in contrast to DIR couplers, have been described, for example, in U.S. Pat. No. 3,632,345. Reference may also be had in this connection to German Offenlegungsschriften Nos. 2,362,752; 2,359,295; 2,405,442, 2,448,063, 2,529,350, 2,540,959, 2,552,505 and German Patent Application P 27 07 489.1.

The intermediate layers which are arranged between the light sensitive silver halide emulsion layers and in which the binder is preferably gelatine may contain compounds which are capable of reacting with the oxidation products of colour developers and thereby prevent unwanted diffusion of these oxidation products. Examples of such compounds include non-diffusible reducing agents such as hydroquinone derivative or couplers which, when they react with colour developer oxidation products, do not give rise to a dye which remains in the layers. Particularly suitable couplers of this kind include the white couplers already mentioned above as well as colour couplers which give rise to a soluble dye which is washed out of the layers during photographic processing. Other suitable compounds for suppressing unwanted diffusion of colour developer oxidation products have been described, for example, in the monograph entitled "Stabilization of Photographic Silver Halide Emulsions" by E. J. Birr, The Focal Press, 1st Edition 1974, pages 116–122.

Information about other suitable additives which may be used in the colour photographic recording materials according to the invention or in one of their layers may be found in the article published in the journal "Product Licensing Index", Volume 92, December 1971, pages 107–110.

The recording materials according to the invention may be developed with the usual colour developer compounds, in particular those based on p-phenylene diamine which have a primary amino group, e.g. 4-amino-N,N-dimethylaniline, 4-amino-N,N-diethyl aniline, 4-amino-3-methyl-N,N-diethyl aniline, 4-amino-3-methyl-N-methyl-N (β-methyl sulphonamido ethyl)-aniline, 4-amino-N-ethyl-N-(β-hydroxy ethyl)-aniline, 4-amino-3-methyl-N-ethyl-N-(β-methoxy ethyl)-aniline, 4-amino-3-methyl-N-ethyl-N-(β-methyl sulphonamido ethyl)-aniline, 4-amino-N-butyl-N-(ω-sulphobutyl)-aniline and 4-amino-3-methyl-N-isopropyl-N-(ω-sulphobutyl)-aniline.

Other suitable colour developers have been described for example, in J. Amer. Chem. Soc. 73, 3100–3125 (1951).

EXAMPLE 1

Two layer arrangements were prepared for comparison purposes in accordance with the instructions given below. The layers were applied in the sequence given below to a transparent layer substrate. The quantities given refer in each case to 1 $m^2$. The silver application is expressed in terms of the corresponding quantities of silver nitrate.

Arrangement 1

1. A less sensitive red-sensitive layer containing a red-sensitive silver iodobromide emulsion (5 mol % silver iodide) of 2.08 g of silver nitrate with 500 mg of a cyan coupler represented by the following formula

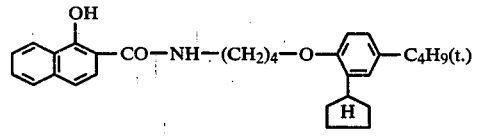

18 mg of a DIR coupler represented by the following formula

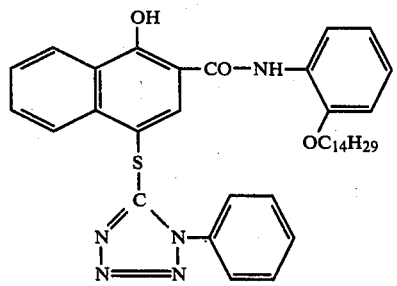

and 50 mg of a masking coupler represented by the following formula

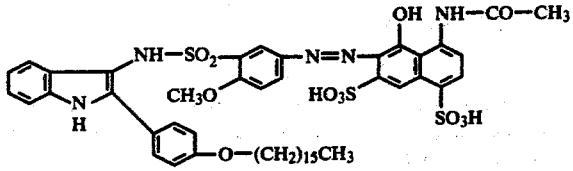

and 1.4 g of gelatine.

2. An intermediate layer of 0.7 g of gelatine and 0.2 g of 2,5-diiso-octylhydroquinone.

3. A less sensitive green-sensitive layer containing a green-sensitised silver iodobromide emulsion (5 mol % silver iodide of 2.3 g of silver nitrate and 720 mg of a magenta coupler represented by the following formula

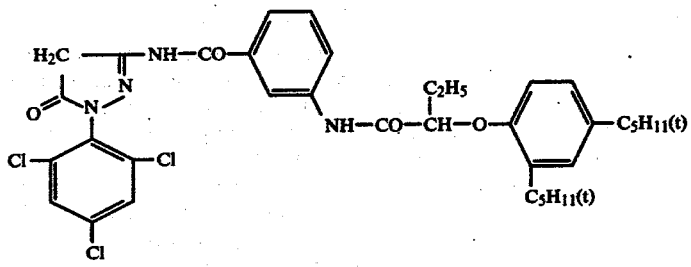

72 mg of a DIR-coupler represented by the following formula

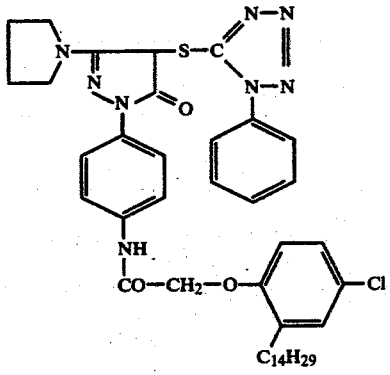

80 mg of a masking coupler represented by the following formula

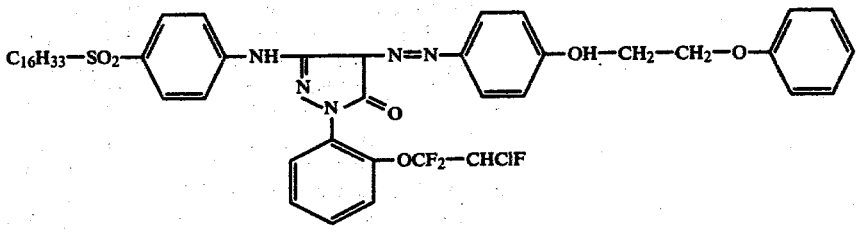

and 2.0 g of gelatine.

4. An intermediate layer the same as layer 2.

5. A highly sensitive red-sensitive layer containing a red-sensitised silver iodobromide emulsion (mol % silver iodide) of 1.8 g of silver nitrate with 230 mg of the cyan coupler used in layer 1 and 0.9 g of gelatine.

6. An intermediate layer the same as layer 2.

7. A highly sensitive green-sensitive layer containing a green-sensitised silver iodobromide emulsion (7 mol % silver iodide) of 2.6 g of silver nitrate with 140 mg of a magenta coupler represented by the following formula

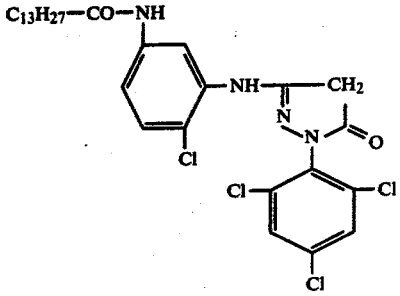

30 mg of a magenta coupler represented by the following formula

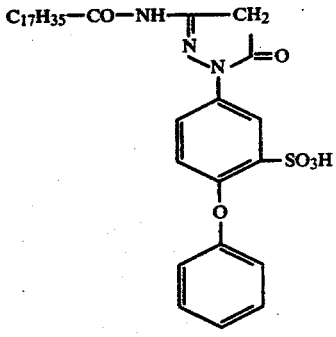

and 1.9 g of gelatine.

8. An intermediate layer the same as layer 2.

9. A yellow filter layer containing colloidal silver for producing a yellow density of 0.8.

10. A blue-sensitive layer containing a mixture of a sensitive silver iodobromide emulsion (9 mol % silver iodide of 1.0 g of silver nitrate and a less sensitive silver iodobromide emulsion (3 mol % silver iodide) of 0.6 g of silver nitrate with 1.0 g of a yellow coupler represented by the following formula

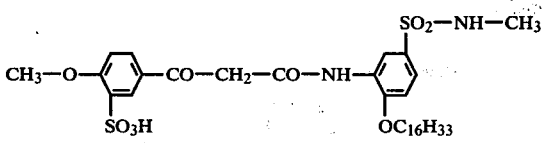

and 2.0 g of gelatine.

11. A covering layer of 0.7 g of gelatine.

Arrangement 2

Arrangement 2 differs from Arrangement 1 in that it contains an additional layer, layer 7a, inserted between the seventh and eighth layer.

Layer 7a: A silver halide-free layer containing 250 mg of the magenta coupler used in layer 3 and 300 mg of gelatine.

Both films (Arrangement 1 and Arrangement 2) were exposed behind a graded wedge and developed by the process described in British Journal of Photography, July 1974, pages 597 to 598. The magenta sensitivity was measured in relative log I.t units, in one case at density 0.2 above fog, in the other case as "inertia speed", which is the relative log I.t value obtained by extrapolating the straight line part of the characteristic curve and finding its point of intersection with the fog density.

| | Magenta sensitivity; rel. log I.t | |
|---|---|---|
| | 0.2 above fog | extrapolated to fog density |
| Arrangement 1 | 4.05 | 4.26 |
| Arrangement 2 | 4.17 | 4.36 |

The sensitivities of the yellow and cyan colour units were the same in arrangements 1 and 2 but the sensitivity of the magenta colour unit was distinctly higher in Arrangement 2 which contained the additional silver halide-free layer according to the invention. The gain in sensitivity is accompanied by a slight increase in gradation.

EXAMPLE 2

The arrangements were prepared from the melts described in Example 1, with the alterations indicated.

Arrangement 1

1. Layer 1 of Example 1 - Application as in Example 1
2. Layer 5 of Example 1 - Application as in Example 1
3. Layer 2 of Example 1 - Application as in Example 1
4. Layer 3 of Example 1 - Application as in Example 1
5. Layer 7 of Example 1 - Application reduced by 25% compared with Example 1
6. Layer 2 of Example 1 - Application as in Example 1
7. Yellow filter layer containing colloidal silver to reduce a yellow density of 0.8.
8. Layer 10 of Example 1 - Application as in Example 1
9. Covering layer of 0.7 g of gelatine.

Arrangement 2

Arrangement 2 is similar to Arrangement 1 but in addition contains 70 mg of a DIR-coupler represented by the following formula

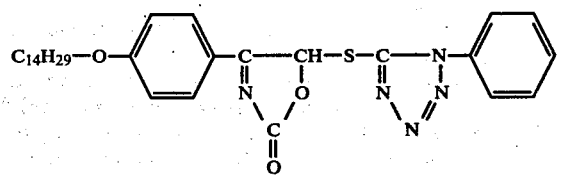

in layer 7.

Arrangement 3

Arrangement 3 is similar to Arrangement 2 except that instead of intermediate layer 6 there is used a layer according to the invention with colour coupler, containing 230 mg of the magenta coupler used in layer 3 of Example 1 and 120 mg of gelatine.

The three arrangements were exposed to light (white light and behind a green filter) and processed as in Example 1. The sensitivity was measured as inertia speed; the magenta inter-image effect was determined in terms of the percentage increase in the gradation produced on exposure to green light in comparison with the gradation produced on exposure to white light. The following results were obtained.

| Arrangement | Magenta sensitivity rel. log I.t | Magenta fog | Magenta inter-image effect % |
|---|---|---|---|
| 1 | 4.08 | 0.62 | 0 |
| 2 | 3.89 | 0.39 | 18 |
| 3 | 3.98 | 0.42 | 20 |

Incorporation of the layer according to the invention thus in this case produces an increase in sensitivity by 0.09 log I.t-units, thus partly compensating for the loss in sensitivity which occurs when the DIR-coupler is incorporated in the yellow filter layer.

What we claim is:

1. The color photographic recording material consisting of a layer support having applied to it a plurality of light-sensitive layers including a red sensitive layer unit comprising two red sensitive silver halide emulsion layers of differing sensitivities, each layer containing a non-diffusible color coupler for producing a cyan dye, the more sensitive of which is further removed from the layer support than the less sensitive, two green sensitive silver halide emulsion layers of differing sensitivities more removed from the layer support than said red sensitive layer unit, each of said green sensitive layers containing a non-diffusible color coupler for producing a magenta dye, the more sensitive of the green sensitive layers being further removed from the layer support than the less sensitive, a non-light-sensitive yellow filter layer more removed from the layer support than said green sensitive silver halide emulsion layers, one or more blue sensitive layers containing a non-diffusing yellow-forming coupler, and being located further removed from the layer support than said yellow filter layer, wherein the improvement comprises a light insensitive layer of binder free from effective amounts of silver halide arranged immediately above said more sensitive green sensitive silver halide emulsion layer and containing a non-diffusible color coupler for producing a magenta dye.

2. A material as claimed in claim 1 in which each more sensitive silver halide emulsion layer contains a higher proportion of silver halide to colour coupler than the respective less sensitive silver halide emulsion layer.

3. A material as claimed in claim 1 in which insensitive binder layer contains one or more colour couplers in a total quantity amounting to from 10 to 80% of the molar quantity of colour coupler contained in the less sensitive green sensitive silver halide emulsion layer.

4. A material as claimed in claim 1 in which the yellow filter layer contains a compound which is capable of reacting with oxidation products of color developer to release a diffusible development inhibitor.

* * * * *